US011848476B2

(12) United States Patent
Lin et al.

(10) Patent No.: US 11,848,476 B2
(45) Date of Patent: Dec. 19, 2023

(54) POWER DIVIDER

(71) Applicant: National Chi Nan University, Puli (TW)

(72) Inventors: Yo-Sheng Lin, Puli (TW); Kai-Siang Lan, Puli (TW); Bo-Shun Chen, Puli (TW)

(73) Assignee: National Chi Nan University, Puli (TW)

( * ) Notice: Subject to any disclaimer, the term of this patent is extended or adjusted under 35 U.S.C. 154(b) by 183 days.

(21) Appl. No.: 17/482,016

(22) Filed: Sep. 22, 2021

(65) Prior Publication Data

US 2022/0416395 A1 Dec. 29, 2022

(30) Foreign Application Priority Data

Jun. 25, 2021 (TW) ..... 110123389

(51) Int. Cl.
*H01P 5/16* (2006.01)

(52) U.S. Cl.
CPC ..... *H01P 5/16* (2013.01)

(58) Field of Classification Search
CPC ..... H01P 5/12; H01P 5/16
See application file for complete search history.

(56) References Cited

U.S. PATENT DOCUMENTS 5,469,129 A * 11/1995 Dydyk ..... H03H 7/48 333/100
6,683,510 B1 * 1/2004 Padilla ..... H01P 5/10 333/25
2003/0151863 A1 * 8/2003 Ralph ..... H01P 5/16 361/38

FOREIGN PATENT DOCUMENTS

JP 2023043721 A * 3/2023

OTHER PUBLICATIONS

Mohammad Behdad Jamshidi , Seed Roshani, Jakub Talla, Sobhan Roshani and Zdenek Peroutka, "Size reduction and performance improvement of a microstrip Wilkinson power divider using a hybrid design technique" Apr. 8, 2021, Scientific Reports, Article No. 7773 (2021) pp. 1-15 (Year: 2021).*

* cited by examiner

*Primary Examiner* — Andrea Lindgren Baltzell
*Assistant Examiner* — Kimberly E Glenn
(74) *Attorney, Agent, or Firm* — Akerman LLP; Peter A. Chiabotti

(57) ABSTRACT

A power divider includes an input capacitor, and first and second transmission lines (TLs). The first TL includes an input portion (IP), a transmission portion (TP) and an output portion (OP). The second TL includes a TP and an OP. The IP is for receiving an input signal, and is connected to the TPs of the first and second TLs. For each of the first and second TLs, the TP has a length that is one-twelfth of a target wavelength, and is connected to the OP. The OPs of the first and second TLs are for cooperatively outputting a pair of output signals which are in-phase and each of which has a frequency equal to that of the input signal. The input capacitor is connected between ground and the IP.

15 Claims, 9 Drawing Sheets

POWER DIVIDER

CROSS-REFERENCE TO RELATED APPLICATION

This application claims priority of Taiwanese Invention Patent Application No. 110123389, filed on Jun. 25, 2021.

FIELD

The disclosure relates to a power dividing technique, and more particularly to a power divider.

BACKGROUND

Referring to FIG. 1, a conventional Wilkinson power divider is configured to operate in a frequency range around and covering a target frequency, and can be used to divide an input signal (Pi) into two output signals (Po) each with a power magnitude half that of the input signal (Pi) and a frequency equal to that of the input signal (Pi). The conventional Wilkinson power divider includes an input portion 10, two transmission portions 11, 12 and two output portions 13, 14. Each of the input portion 10, the two transmission portions 11, 12 and the two output portions 13, 14 is implemented to be a transmission line.

Each of the two transmission portions 11, 12 has a length of $\lambda/4$, where $\lambda$ is a target wavelength corresponding to the target frequency. Moreover, the two transmission portions 11, 12 have to be far apart from each other to avoid electromagnetic coupling therebetween. Therefore, the conventional Wilkinson power divider disadvantageously occupies a relatively large area and has a relatively high manufacturing cost. In addition, the two transmission portions 11, 12 are usually laid out in an asymmetric way (not shown) instead of a symmetric way in view of restrictions imposed by a limited chip area. However, the aforementioned asymmetric layout may cause relatively large amplitude imbalance and phase difference between the two output signals (Po).

SUMMARY

Therefore, an object of the disclosure is to provide a power divider that can alleviate at least one of the drawbacks of the prior art.

According to the disclosure, the power divider is configured to operate in a frequency range around and covering a target frequency. The power divider includes a first transmission line, a second transmission line and an input capacitor.

The first transmission line includes an input portion, a first transmission portion and a first output portion. Each of the input portion, the first transmission portion and the first output portion has a first terminal, and a second terminal that is distal from the first terminal of the input portion. The first terminal of the input portion is for receiving an input signal. The second terminal of the input portion is connected to the first terminal of the first transmission portion. The second terminal of the first transmission portion is connected to the first terminal of the first output portion. The first transmission portion has a length that is one-twelfth of a target wavelength corresponding to the target frequency.

The second transmission line includes a second transmission portion and a second output portion. Each of the second transmission portion and the second output portion has a first terminal, and a second terminal that is distal from the first terminal of the input portion. The second terminal of the input portion is further connected to the first terminal of the second transmission portion. The second terminal of the second transmission portion is connected to the first terminal of the second output portion. The second terminal of the first output portion and the second terminal of the second output portion are for cooperatively outputting a pair of output signals which are in-phase and each of which has a frequency equal to that of the input signal. The second transmission portion has a length that is one-twelfth of the target wavelength.

The input capacitor is electrically connected between ground and the second terminal of the input portion.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
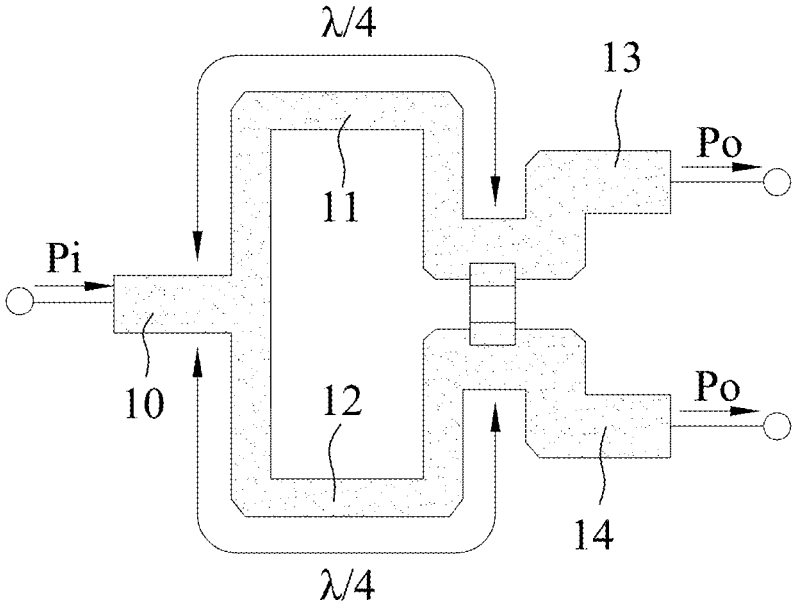
FIG. 1 PRIOR ART
FIG. 1 is a structural diagram illustrating a conventional Wilkinson power divider.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
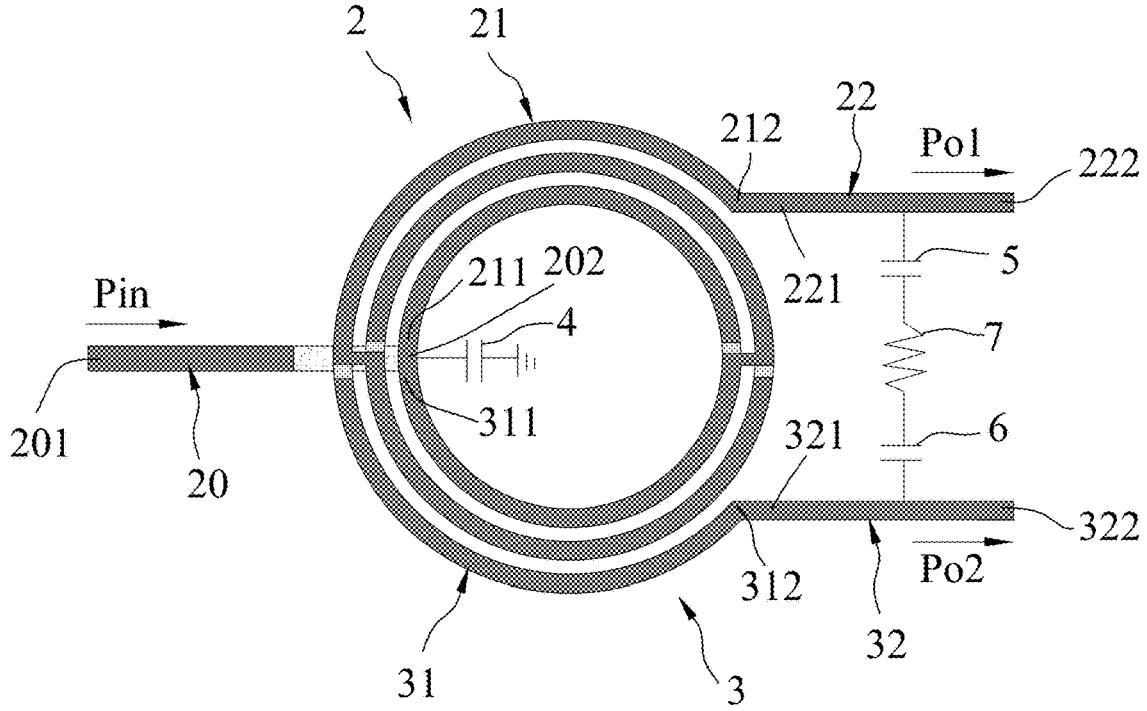
FIG. 2 is a schematic diagram illustrating a first embodiment of a power divider according to the disclosure.

Referring to FIG. 2, a first embodiment of a power divider according to the disclosure is illustrated.

The power divider is configured to operate in a frequency range around and covering a target frequency. The power divider includes a first transmission line 2, a second transmission line 3, an input capacitor 4, a first output capacitor 5, a second output capacitor 6 and an output resistor 7.

The first transmission line 2 includes an input portion 20, a first transmission portion 21 and a first output portion 22.

Each of the input portion 20, the first transmission portion 21 and the first output portion 22 has a first terminal 201/211/221, and a second terminal 202/212/222 that is distal from the first terminal 201 of the input portion 20. The first terminal 201 of the input portion 20 is for receiving an input signal (Pin), which has a power magnitude of P. The second terminal 202 of the input portion 20 is connected to the first terminal 211 of the first transmission portion 21. The second terminal 212 of the first transmission portion 21 is connected to the first terminal 221 of the first output portion 22. The first transmission portion 21 has a length that is one-twelfth of a target wavelength corresponding to the target frequency. That is, the length of the first transmission portion 21 is $\lambda/12$, where $\lambda$ is the target wavelength.

The second transmission line 3 includes a second transmission portion 31 and a second output portion 32. Each of the second transmission portion 31 and the second output portion 32 has a first terminal 311/321, and a second terminal 312/322 that is distal from the first terminal 201 of the input portion 20. The second terminal 202 of the input portion 20 is further connected to the first terminal 311 of the second transmission portion 31. The second terminal 312 of the second transmission portion 31 is connected to the first terminal 321 of the second output portion 32. The second terminal 222 of the first output portion 22 and the second terminal 322 of the second output portion 32 are for cooperatively outputting a pair of output signals (Po1, Po2) which are in-phase and each of which has a frequency equal to that of the input signal (Pin). In addition, each of the output signals (Po1, Po2) has a power magnitude equal to one half of that of the input signal (Pin), i.e., P/2. The second transmission portion 31 has a length that is one-twelfth of the target wavelength (i.e., $\lambda/12$).

The input capacitor 4 is electrically connected between ground and the second terminal 202 of the input portion 20.

The first output capacitor 5, the output resistor 7 and the second output capacitor 6 are sequentially connected in series between the first output portion and the second output portion 32. Specifically speaking, each of the first and second output capacitors 5, 6 has a first terminal and a second terminal. The second terminal of the first output capacitor 5 is electrically connected to the first output portion 22, and the second terminal of the second output capacitor 6 is electrically connected to the second output portion 32. The output resistor 7 is electrically connected between the first terminals of the first and second output capacitors 5, 6.

In this embodiment, a characteristic impedance ($Z_T$) of each of the first and second transmission portions 21, 31 can be expressed by the following equation:

$$Z_T = R_0 \times \frac{\sqrt{1+\sin^2\theta}}{\sin\theta},$$

where $R_0$ denotes a resistance of the power divider, and is 50Ω in this embodiment, and where θ denotes an electrical length of the corresponding one of the first and second transmission portions 21, 31. In order to alleviate adverse effects resulting from power loss of a transmission line under restrictions of fabrication, each of the first and second transmission portions 21, 31 is designed to have a width of 4 μm and a characteristic impedance ($Z_T$) of 100Ω. Based on the aforementioned equation, the electrical length (θ) is 30.7° (i.e., a physical length of the transmission portion 21 or 31 is about $\lambda/12$) when the characteristic impedance ($Z_T$) is 100Ω and the resistance ($R_0$) is 50Ω.

It is worth to note that the power divider is fabricated using a 0.18 μm complementary metal-oxide-semiconductor (CMOS) process technology. The first transmission portion 21 and the second transmission portion 31 are disposed in line symmetry relative to each other. The first output portion 22 and the second output portion 32 are disposed in line symmetry relative to each other. Arc segments of the first transmission portion 21 and the second transmission portion 31 are concentric, and radially adjacent arc segments are arranged at uniform spacing from each other and alternate between being part of the first transmission portion 21 and being part of the second transmission portion 31. The first output portion 22 and the second output portion 32 are parallel to each other. The first transmission portion 21 is configured as a circular spiral in a clockwise direction, and the second transmission portion 31 is configured as a circular spiral in a counterclockwise direction, so electric currents flow in the first and second transmission portions 21, 31 in opposite directions. In this way, the first transmission portion 21 and the second transmission portion 31 establish reversed-phase electromagnetic coupling with each other, and for each of the first and second transmission portions 21, 31, an equivalent inductance thereof is less than a self-inductance thereof. It should be noted herein that the first and second transmission portions 21, 31 can take the form of spirals other than circular spirals, such as rectangular spirals.

The input signal (Pin) fed into the power divider via the first terminal 201 of the input portion 20 is split into two partial signals at the second terminal 202 of the input portion 20, where each of the two partial signals has a frequency equal to that of the input signal (Pin) and a power magnitude half that of the input signal (Pin). One of the two partial signals passes through the first transmission portion 21 in the clockwise direction, passes through the first output portion 22, and leaves the power divider at the second terminal 222 of the first output portion 22 to serve as the output signal (Po1). Similarly, the other of the two partial signals passes through the second transmission portion 31 in the counterclockwise direction, passes through the second output portion 32, and leaves the power divider at the second terminal 322 of the second output portion 32 to serve as the output signal (Po2).

Figure 3:
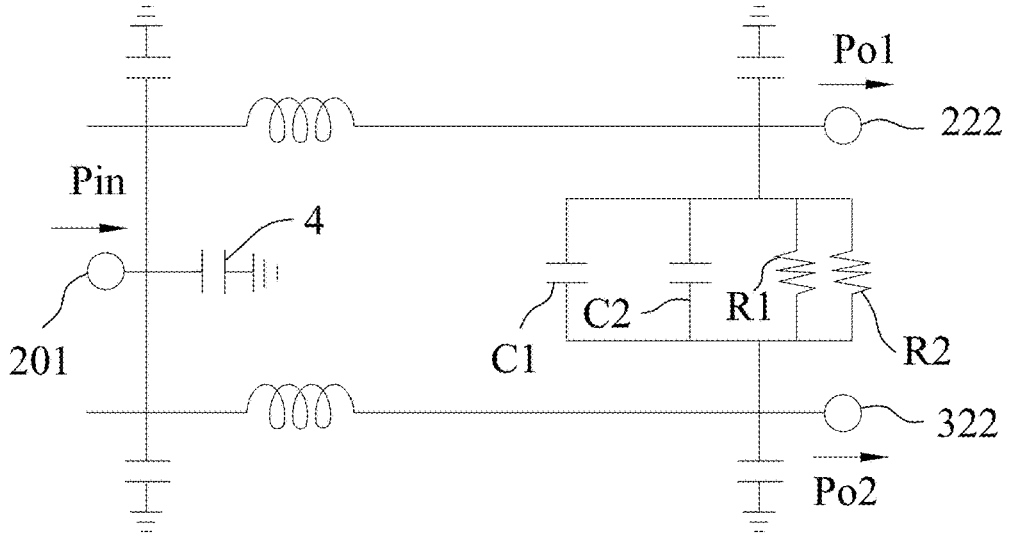
FIG. 3 is a circuit diagram illustrating an equivalent circuit of the first embodiment.

Referring to FIGS. 2 and 3, wherein FIG. 3 illustrates an equivalent circuit of the power divider of this embodiment. In the equivalent circuit, a capacitor (C1) and a resistor (R1) connected in parallel are respectively an equivalent capacitor and an equivalent resistor resulting from a mutual inductance between the first and second transmission portions 21, 31. Another capacitor (C2) and another resistor (R2) connected in parallel are respectively an equivalent capacitor and an equivalent resistor of the series connection of the first output capacitor 5, the output resistor 7 and the second output capacitor 6.

In this embodiment, the power divider is implemented to be a Ka-band two-way power divider (i.e., the frequency range in which the power divider operates is from 26.5 GHz to 40 GHz), and each of the first and second transmission portions 21, 31 has a 1.35-turn configuration.

In a scenario where the first terminal 201 of the input portion 20 serves as a first port, the second terminal 222 of the first output portion 22 serves as a second port, and the second terminal 322 of the second output portion 32 serves as a third port, a scattering parameter (also referred to as S parameter) matrix of the power divider of this embodiment can be expressed by the following equation:

$$[S] = \begin{bmatrix} S_{11} & S_{12} & S_{13} \\ S_{21} & S_{22} & S_{23} \\ S_{31} & S_{32} & S_{33} \end{bmatrix},$$

where the scattering parameter ($S_{22}$) denotes a reflection coefficient at the second port, the scattering parameter ($S_{33}$) denotes a reflection coefficient at the third port, the scattering parameter ($S_{32}$) is related to an isolation between the second and third ports, the scattering parameter ($S_{21}$) denotes a complex linear gain from the first port to the second port, and the scattering parameter ($S_{31}$) denotes a complex linear gain from the first port to the third port.

By utilizing the first output capacitor 5, the second output capacitor 6 and the output resistor 7, a magnitude of each of the scattering parameters ($S_{22}$, $S_{32}$, $S_{33}$) approximates its ideal value of 0, and performance of the power divider may thereby be improved. It is worth to note that a resistance of the output resistor 7 and capacitances of the first and second output capacitors 5, 6 are related to the target frequency of the power divider. For example, when the target frequency of the power divider is 60 GHz, the resistance of the output resistor 7 is 45Ω and the capacitance of each of the first and second output capacitors 5, 6 is 135 fF.

Figure 4:
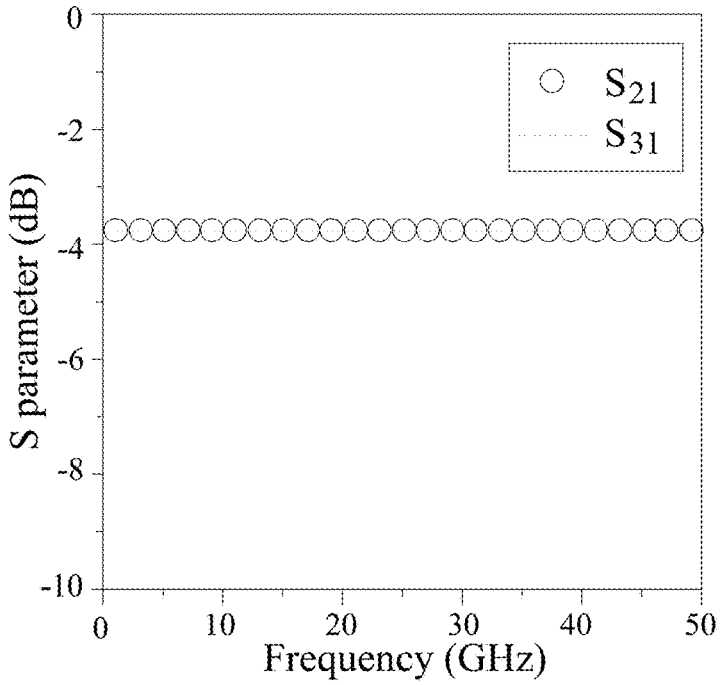
FIG. 4 is a plot illustrating magnitudes of various scattering parameters versus frequency characteristics of the first embodiment.
Figure 5:
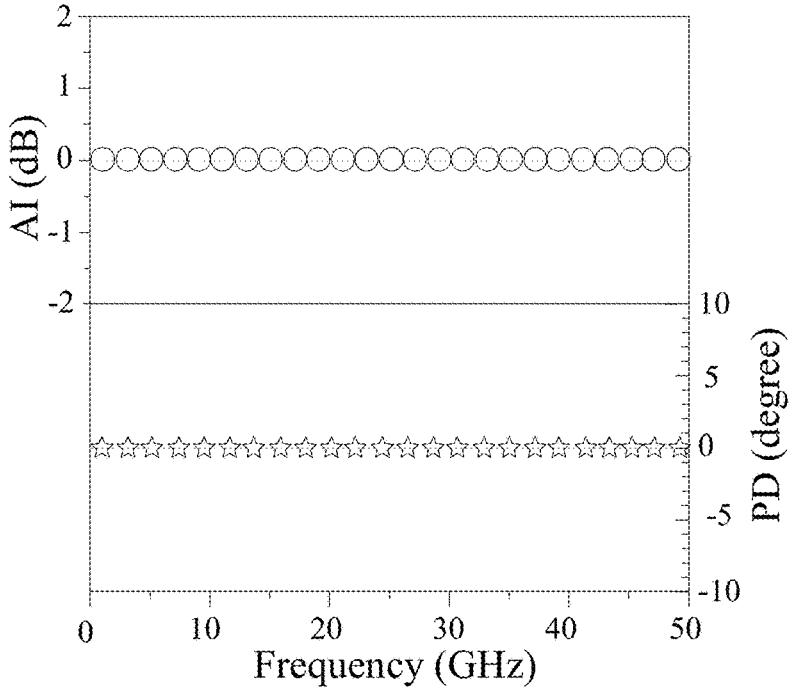
FIG. 5 is a plot illustrating simulated amplitude imbalance and phase difference of the first embodiment.

FIGS. 4 and 5 illustrate simulation results of magnitudes of the scattering parameter ($S_{21}$) and the scattering parameter ($S_{31}$) when the frequency of the input signal (Pin) (see FIG. 2) is within a range of 0 GHz to 50 GHz. It can be reasonably determined from FIG. 4 that, for each frequency in the range of 0 GHz to 50 GHz, the magnitude of each of the scattering parameters ($S_{21}$, $S_{31}$) approximates its ideal value of −3 dB. Moreover, it can be reasonably determined from FIG. 5 that, for each frequency in the range of 0 GHz to 50 GHz, a difference between the magnitudes of the scattering parameters ($S_{21}$, $S_{31}$) (i.e., $|S_{21}|-|S_{31}|$, hereinafter also referred to as amplitude imbalance, AI) approximates its ideal value (which is indicated by a dash line) of 0 dB, and a difference between phases of the scattering parameters ($S_{21}$, $S_{31}$) (i.e., $\angle S_{21}-\angle S_{31}$, hereinafter also referred to as phase difference, PD) approximates its ideal value (which is indicated by a dash line) of 0 degrees. In other words, the power divider of this embodiment has small power loss, and has excellent performance of dividing power in aspects of amplitude balance and phase balance because the pair of output signals (Po1, Po2) (see FIG. 2) are substantially in-phase and have substantially equal power.

Figure 6:
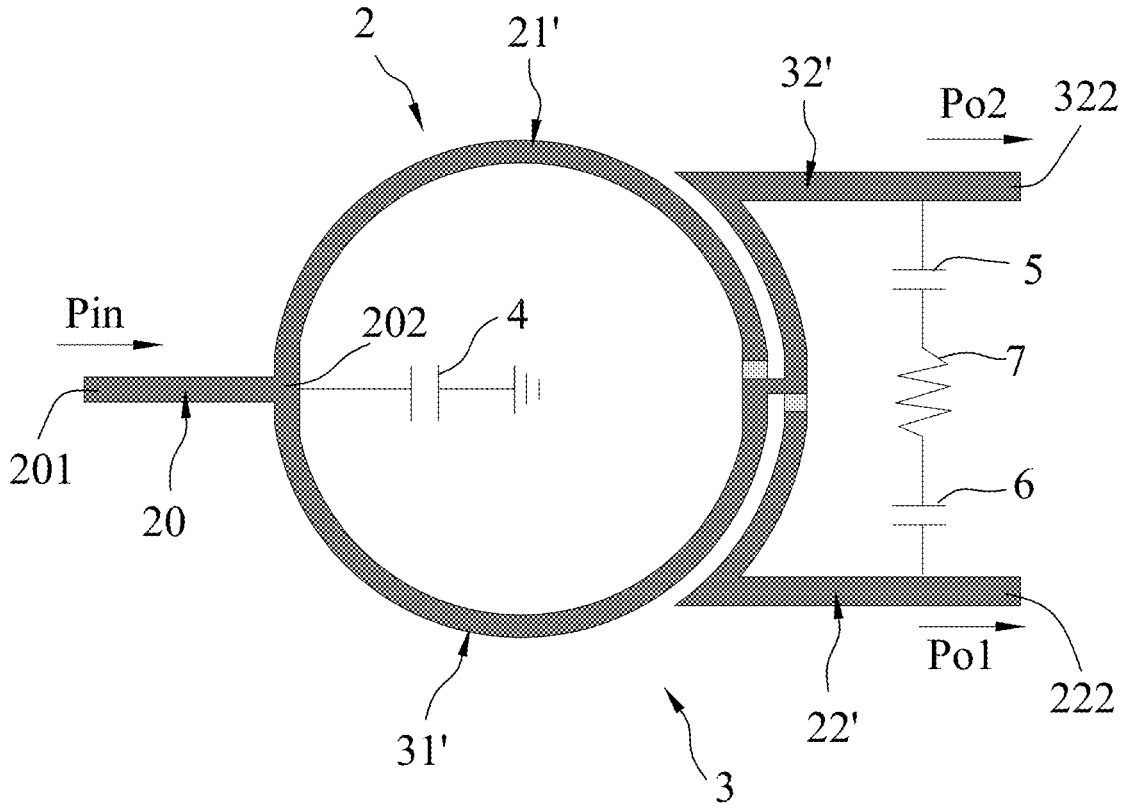
FIG. 6 is a schematic diagram illustrating a second embodiment of the power divider according to the disclosure.

Referring to FIG. 6, a second embodiment of the power divider according to the disclosure is illustrated. The second embodiment is similar to the first embodiment, and only the differences between the first and second embodiments will be explained in the following paragraphs for the sake of brevity.

The first transmission portion 21' and the first output portion 22' in FIG. 6 respectively correspond to the first transmission portion 21 and the first output portion 22 in FIG. 2. The second transmission portion 31' and the second output portion 32' in FIG. 6 respectively correspond to the second transmission portion 31 and the second output portion 32 in FIG. 2.

The second terminal of the first output capacitor 5 is electrically connected to the second output portion 32', and the second terminal of the second output capacitor 6 is electrically connected to the first output portion 22'.

The first transmission portion 21' is configured as an arc extending in a first direction, and the second transmission portion 31' is configured as an arc extending in a second direction that is opposite to the first direction. In this embodiment, the first direction is a clockwise direction, and the second direction is a counterclockwise direction.

In this embodiment, the power divider is implemented to be a V-band two-way power divider (i.e., the frequency range in which the power divider operates is from 50 GHz to 70 GHz), and each of the first and second transmission portions 21', 31' has a 0.65-turn configuration.

Figure 7:
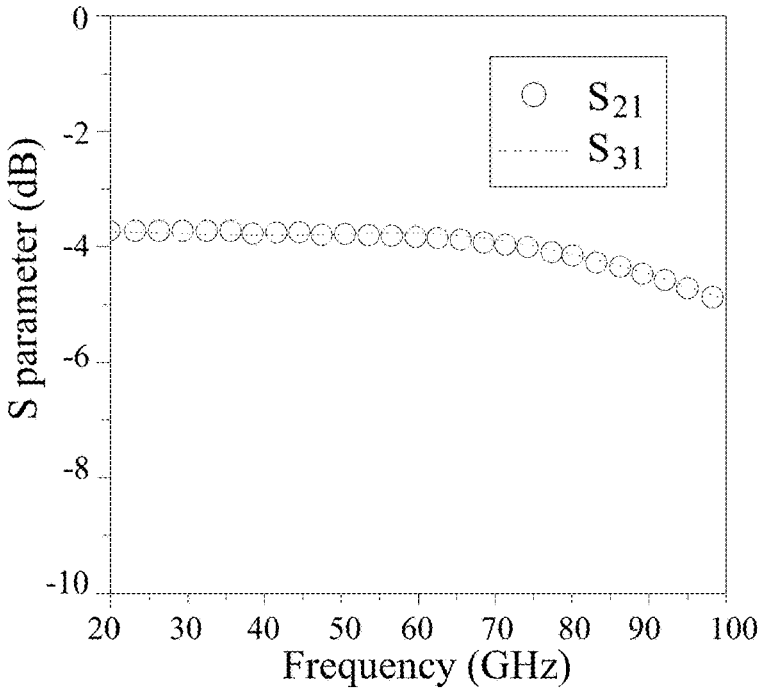
FIG. 7 is a plot illustrating magnitudes of various scattering parameters versus frequency characteristics of the second embodiment.
Figure 8:
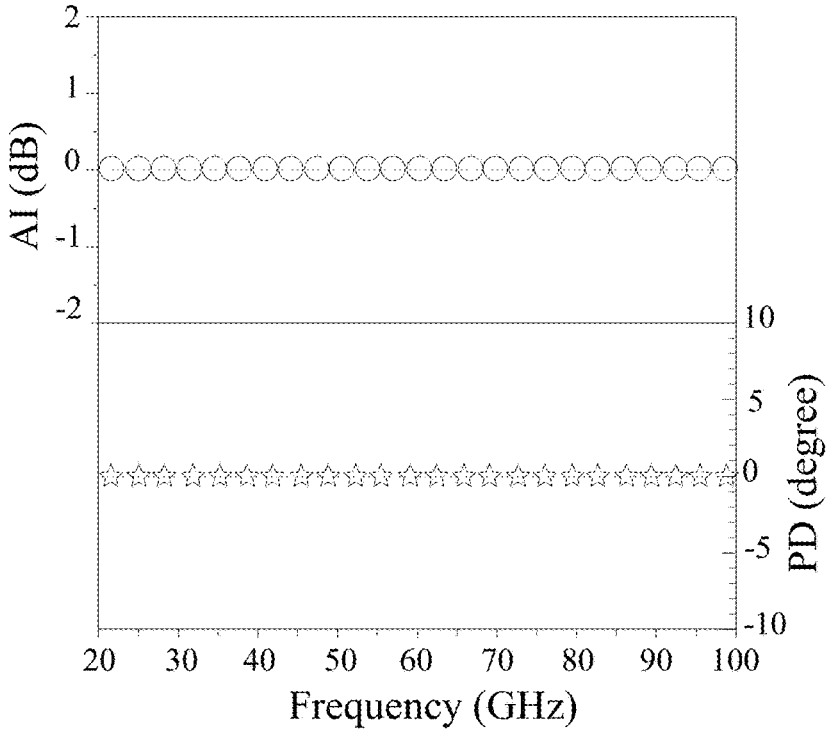
FIG. 8 is a plot illustrating simulated amplitude imbalance and phase difference of the second embodiment.

FIGS. 7 and 8 illustrate simulation results of magnitudes of the scattering parameter ($S_{21}$) and the scattering parameter ($S_{31}$) when the frequency of the input signal (Pin) (see FIG. 6) is within a range of 20 GHz to 100 GHz. It can be reasonably determined from FIG. 7 that, for each frequency in the range of 20 GHz to 70 GHz, the magnitude of each of the scattering parameters ($S_{21}$, $S_{31}$) approximates its ideal value of −3 dB. In addition, it can be reasonably determined from FIG. 8 that, for each frequency in the range of 20 GHz to 100 GHz, a difference between the magnitudes of the scattering parameters ($S_{21}$, $S_{31}$) (i.e., $|S_{21}|-|S_{31}|$) approximates its ideal value (which is indicated by a dash line) of 0 dB, and a difference between phases of the scattering parameters ($S_{21}$, $S_{31}$) (i.e., $\angle S_{21}-\angle S_{31}$) approximates its ideal value (which is indicated by a dash line) of 0 degrees. In other words, the power divider of this embodiment also has small power loss, and has excellent performance of dividing power in aspects of amplitude balance and phase balance because the pair of output signals (Po1, Po2) (see FIG. 6) are substantially in-phase and have substantially equal power.

Figure 9:
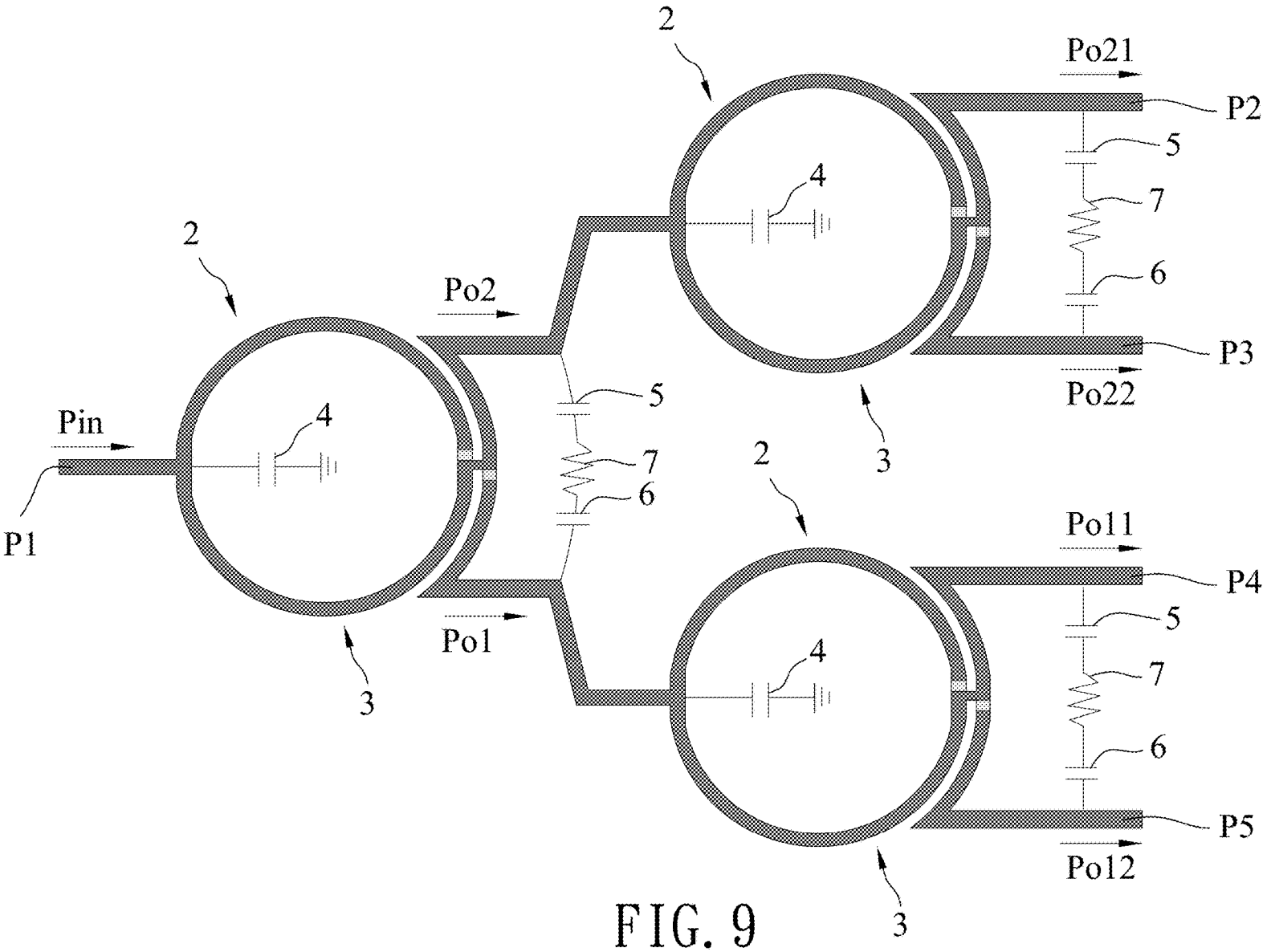
FIG. 9 is a schematic diagram illustrating an application of the second embodiment of the power divider according to the disclosure.

Referring to FIG. 9, an application of the second embodiment of the power divider according to the disclosure is illustrated.

Specifically, three copies of the second embodiment of the power divider (see FIG. 6) are arranged to form a V-band four-way power divider (i.e., a frequency range in which the V-band four-way power divider operates is from 50 GHz to 70 GHz). The V-band four-way power divider is configured to divide an input signal (Pin) into four output signals (Po11, Po12, Po21, Po22).

In a scenario where an input terminal (P1) for receiving the input signal (Pin) serves as a first port, and output terminals (P2, P3, P4, P5) respectively outputting the four output signals (Po21, Po22, Po11, Po12) respectively serve as second, third, fourth and fifth ports, a scattering parameter matrix of the V-band four-way power divider can be expressed by the following equation:

$$[S] = \begin{bmatrix} S_{11} & S_{12} & S_{13} & S_{14} & S_{15} \\ S_{21} & S_{22} & S_{23} & S_{24} & S_{25} \\ S_{31} & S_{32} & S_{33} & S_{34} & S_{35} \\ S_{41} & S_{42} & S_{43} & S_{44} & S_{45} \\ S_{51} & S_{52} & S_{53} & S_{54} & S_{55} \end{bmatrix},$$

wherein the scattering parameter ($S_{21}$) denotes a complex linear gain from the first port to the second port, the scattering parameter ($S_{31}$) denotes a complex linear gain from the first port to the third port, the scattering parameter ($S_{41}$) denotes a complex linear gain from the first port to the fourth port, and the scattering parameter ($S_{51}$) denotes a complex linear gain from the first port to the fifth port.

An amplitude-imbalance parameter ($AI_{23}$) representing an amplitude imbalance between the scattering parameters ($S_{21}$, $S_{31}$) is a difference between magnitudes of the scattering parameters ($S_{21}$, $S_{31}$), and can be mathematically expressed as: $AI_{23}=|S_{21}|-|S_{31}|$. An amplitude-imbalance parameter ($AI_{24}$) representing an amplitude imbalance between the scattering parameters ($S_{21}$, $S_{41}$) is a difference between magnitudes of the scattering parameters ($S_{21}$, $S_{41}$), and can be mathematically expressed as: $AI_{24}=|S_{21}|-|S_{41}|$. An amplitude-imbalance parameter ($AI_{25}$) representing an amplitude imbalance between the scattering parameters ($S_{21}$, $S_{51}$) is a difference between magnitudes of the scattering parameters ($S_{21}$, $S_{51}$), and can be mathematically expressed as: $AI_{25}=|S_{21}|-|S_{51}|$.

A phase-difference parameter ($PD_{23}$) representing phase difference between the scattering parameters ($S_{21}$, $S_{31}$) is a difference between phases of the scattering parameters ($S_{21}$, $S_{31}$), and can be mathematically expressed as: $PD_{23}=\angle S_{21}-\angle S_{31}$. A phase-difference parameter ($PD_{24}$) representing a phase difference between the scattering parameters ($S_{21}$, $S_{41}$) is a difference between phases of the scattering parameters ($S_{21}$, $S_{41}$), and can be mathematically expressed as: $PD_{24}=\angle S_{21}-|\angle S_{41}$. A phase-difference parameter ($PD_{25}$) representing a phase difference between the scattering parameters ($S_{21}$, $S_{51}$) is a difference between phases of the scattering parameters ($S_{21}$, $S_{51}$), and can be mathematically expressed as: $PD_{25}=\angle S_{21}-\angle S_{51}$.

Figure 10:
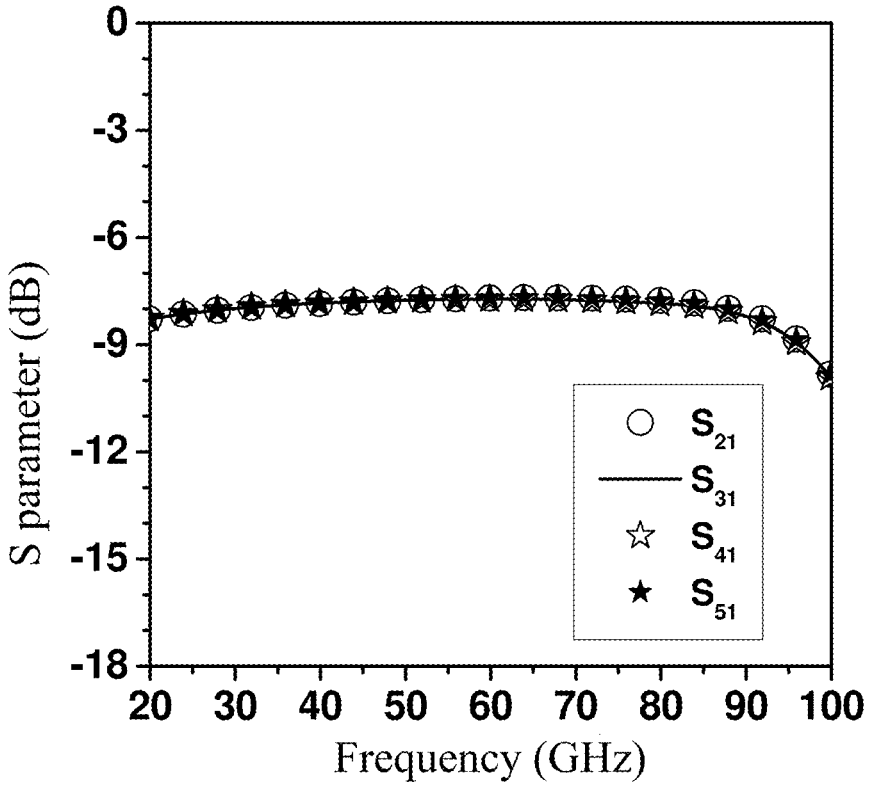
FIG. 10 is a plot illustrating magnitudes of various scattering parameters versus frequency characteristics of the application of the second embodiment.
Figure 11:
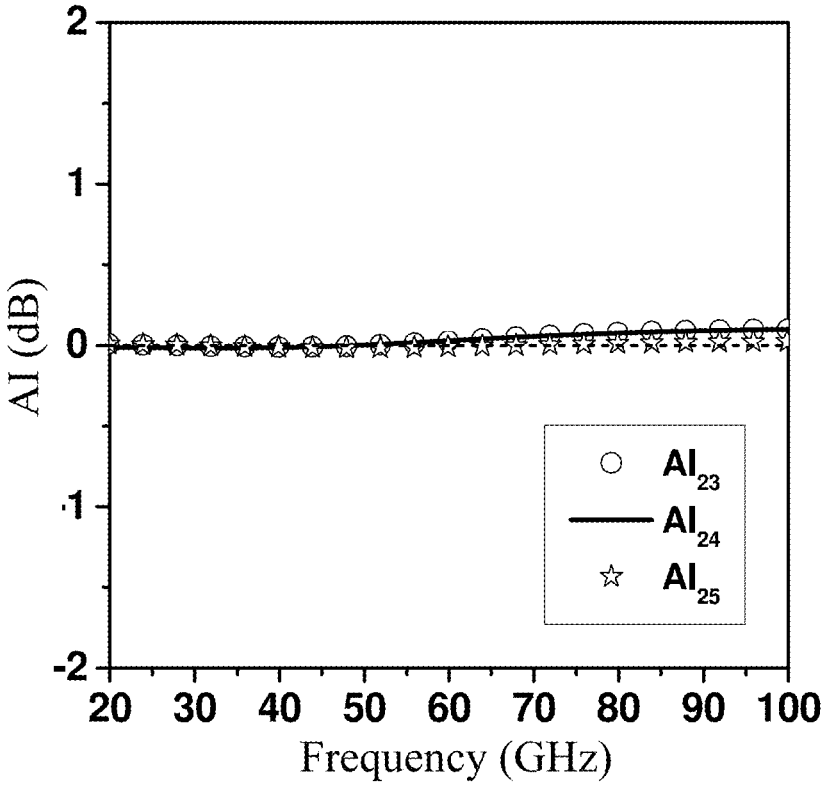
FIG. 11 is a plot illustrating simulated amplitude imbalance of the application of the second embodiment.
Figure 12:
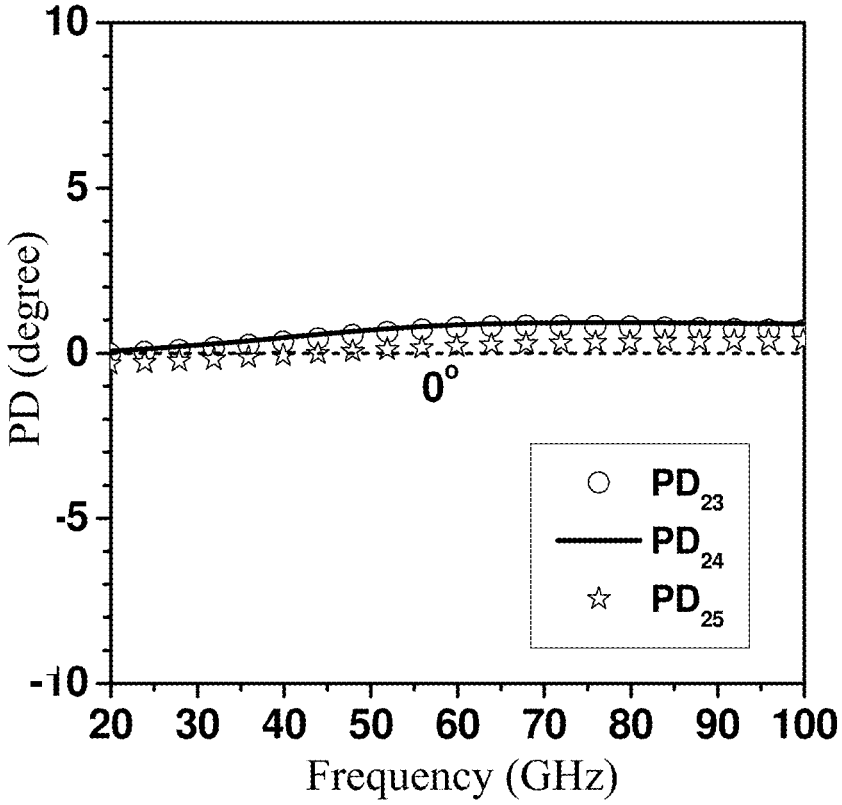
FIG. 12 is a plot illustrating simulated phase difference of the application of the second embodiment.

FIGS. 10 to 12 illustrate simulation results of the magnitudes of the scattering parameters ($S_{21}$, $S_{31}$, $S_{41}$, $S_{51}$), the amplitude-imbalance parameters ($AI_{23}$, $AI_{24}$, $AI_{25}$) and the phase-difference parameters ($PD_{23}$, $PD_{24}$, $PD_{25}$) when the frequency of the input signal (Pin) (see FIG. 9) is within a range of 20 GHz to 100 GHz. It can be reasonably determined from FIGS. 10 to 12 that, for each frequency in the range of 20 GHz to 100 GHz, the V-band four-way power divider has small power loss, and has excellent performance of dividing power in aspects of amplitude balance and phase balance because the four output signals (Po11, Po12, Po21, Po22) (see FIG. 9) are substantially in-phase and have substantially equal power.

It is worth to note that in practice, multiple copies of two-way power dividers (e.g., the first embodiment shown in FIG. 2 or the second embodiment shown in FIG. 6) can be arranged to form an N-way power divider, where N is a positive integer greater than two (e.g., 4 or 8). Moreover, arrangement of the N-way power divider is not limited to the disclosure herein and may vary in other applications.

Referring back to FIGS. 2 and 6, in view of the above, the power divider of each of the aforesaid embodiments has the following advantages.

1. Since each of the first and second transmission portions 21/21', 31/31' has a length that is one-twelfth of the target wavelength, and since the first and second transmission portions 21/21', 31/31' are arranged to have their arc segments alternately arranged, the power divider occupies a relatively small area and has a relatively low manufacturing cost.

2. Since the first and second transmission portions 21/21', 31/31' occupy a relatively small area, the first transmission portion 21/21' and the first output portion 22/22' can be disposed in line symmetry relative to the second transmission portion 31/31' and the second output portion 32/32', respectively. In this way, the pair of the output signals (Po1, Po2) split from the input signal (Pin) may respectively pass through symmetrical transmission paths that have equal lengths, reducing amplitude imbalance and phase difference between the two output signals (Po1, Po2) outputted by the power divider.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A power divider configured to operate in a frequency range around and covering a target frequency, said power divider comprising:

a first transmission line including an input portion, a first transmission portion and a first output portion, each of said input portion, said first transmission portion and said first output portion having a first terminal, and a second terminal that is distal from said first terminal of said input portion, said first terminal of said input portion being for receiving an input signal, said second terminal of said input portion being connected to said first terminal of said first transmission portion, said second terminal of said first transmission portion being connected to said first terminal of said first output portion, said first transmission portion having a length that is one-twelfth of a target wavelength corresponding to the target frequency;

a second transmission line including a second transmission portion and a second output portion, each of said second transmission portion and said second output portion having a first terminal, and a second terminal that is distal from said first terminal of said input portion, said second terminal of said input portion being further connected to said first terminal of said second transmission portion, said second terminal of said second transmission portion being connected to said first terminal of said second output portion, said second terminal of said first output portion and said second terminal of said second output portion being for cooperatively outputting a pair of output signals which are in-phase and each of which has a frequency equal to that of the input signal, said second transmission portion having a length that is one-twelfth of the target wavelength;

an input capacitor electrically connected between ground and said second terminal of said input portion;

a first output capacitor;

an output resistor; and a second output capacitor;

wherein said first output capacitor, said output resistor and said second output capacitor are sequentially connected in series between said first output portion and said second output portion.

2. The power divider of claim 1, wherein:

said first transmission portion and said second transmission portion are disposed in line symmetry relative to each other; and said first output portion and said second output portion are disposed in line symmetry relative to each other.

3. The power divider of claim 1, wherein:

said first transmission portion is configured as a circular spiral in one of clockwise and counterclockwise directions; and said second transmission portion is configured as a circular spiral in the other of clockwise and counterclockwise directions.

4. The power divider of claim 3, wherein:

arc segments of said first transmission portion and said second transmission portion are concentric, and radially adjacent ones of said arc segments are arranged at uniform spacing from each other and alternate between being part of said first transmission portion and being part of said second transmission portion; and said first output portion and said second output portion are parallel to each other.

5. The power divider of claim 1, wherein:

said first transmission portion is configured as an arc extending in a first direction; and said second transmission portion is configured as an arc extending in a second direction that is opposite to the first direction.

6. The power divider of claim 5, wherein:

the first direction is a clockwise direction; and the second direction is a counterclockwise direction.

7. The power divider of claim 1, wherein said first transmission portion and said second transmission portion establish reversed-phase electromagnetic coupling with each other.

8. A power divider configured to operate in a frequency range around and covering a target frequency, said power divider comprising:

a first transmission line including an input portion, a first transmission portion and a first output portion, each of said input portion, said first transmission portion and said first output portion having a first terminal, and a second terminal that is distal from said first terminal of said input portion, said first terminal of said input portion being for receiving an input signal, said second terminal of said input portion being connected to said first terminal of said first transmission portion, said second terminal of said first transmission portion being connected to said first terminal of said first output portion, said first transmission portion having a length that is one-twelfth of a target wavelength corresponding to the target frequency;

a second transmission line including a second transmission portion and a second output portion, each of said second transmission portion and said second output portion having a first terminal, and a second terminal that is distal from said first terminal of said input portion, said second terminal of said input portion being further connected to said first terminal of said second transmission portion, said second terminal of said second transmission portion being connected to said first terminal of said second output portion, said second terminal of said first output portion and said second terminal of said second output portion being for cooperatively outputting a pair of output signals which are in-phase and each of which has a frequency equal to that of the input signal, said second transmission portion having a length that is one-twelfth of the target wavelength; and an input capacitor electrically connected between ground and said second terminal of said input portion, wherein said first transmission portion is configured as a circular spiral in one of clockwise and counterclockwise directions, and wherein said second transmission portion is configured as a circular spiral in the other of clockwise and counterclockwise directions.

9. The power divider of claim 8, wherein:

said first transmission portion and said second transmission portion are disposed in line symmetry relative to each other; and said first output portion and said second output portion are disposed in line symmetry relative to each other.

10. The power divider of claim 8, wherein:

arc segments of said first transmission portion and said second transmission portion are concentric, and radially adjacent ones of said arc segments are arranged at uniform spacing from each other and alternate between being part of said first transmission portion and being part of said second transmission portion; and said first output portion and said second output portion are parallel to each other.

11. The power divider of claim 8, wherein said first transmission portion and said second transmission portion establish reversed-phase electromagnetic coupling with each other.

12. A power divider configured to operate in a frequency range around and covering a target frequency, said power divider comprising:

a first transmission line including an input portion, a first transmission portion and a first output portion, each of said input portion, said first transmission portion and said first output portion having a first terminal, and a second terminal that is distal from said first terminal of said input portion, said first terminal of said input portion being for receiving an input signal, said second terminal of said input portion being connected to said first terminal of said first transmission portion, said second terminal of said first transmission portion being connected to said first terminal of said first output portion, said first transmission portion having a length that is one-twelfth of a target wavelength corresponding to the target frequency;

a second transmission line including a second transmission portion and a second output portion, each of said second transmission portion and said second output portion having a first terminal, and a second terminal that is distal from said first terminal of said input portion, said second terminal of said input portion being further connected to said first terminal of said second transmission portion, said second terminal of said second transmission portion being connected to said first terminal of said second output portion, said second terminal of said first output portion and said second terminal of said second output portion being for cooperatively outputting a pair of output signals which are in-phase and each of which has a frequency equal to that of the input signal, said second transmission portion having a length that is one-twelfth of the target wavelength; and an input capacitor electrically connected between ground and said second terminal of said input portion, wherein said first transmission portion is configured as an arc extending in a first direction, and wherein said second transmission portion is configured as an arc extending in a second direction that is opposite to the first direction.

13. The power divider of claim 12, wherein:

said first transmission portion and said second transmission portion are disposed in line symmetry relative to each other; and said first output portion and said second output portion are disposed in line symmetry relative to each other.

14. The power divider of claim 12, wherein:

the first direction is a clockwise direction; and the second direction is a counterclockwise direction.

15. The power divider of claim 12, wherein said first transmission portion and said second transmission portion establish reversed-phase electromagnetic coupling with each other.

* * * * *